US006035964A

United States Patent [19]

Lange

[11] Patent Number: 6,035,964

[45] Date of Patent: Mar. 14, 2000

[54] GAS TURBINE MUFFLER WITH DIFFUSOR

[75] Inventor: Kurt-Jurgen Lange, Zeitz, Germany

[73] Assignee: ALSTOM Energy Systems GmbH, Stuttgart, Germany

[21] Appl. No.: 09/238,442

[22] Filed: Jan. 28, 1999

[30] Foreign Application Priority Data

Jan. 28, 1998 [DE] Germany ..... 198 03 161

[51] Int. Cl.[7] ..... E04F 17/04

[52] U.S. Cl. ..... 181/224; 181/264

[58] Field of Search ..... 181/229, 224, 181/210, 213, 214, 217, 218, 219, 264

[56] References Cited

U.S. PATENT DOCUMENTS

| | | | |
|---|---|---|---|
| 3,033,307 | 5/1962 | Sanders et al. | 181/224 |
| 3,739,872 | 6/1973 | Mc.Nair | 181/229 |
| 4,287,962 | 9/1981 | Ingard et al. | 181/224 |
| 5,728,979 | 3/1998 | Yazici et al. | 181/224 |

FOREIGN PATENT DOCUMENTS 28 55 219 12/1978 Germany .

*Primary Examiner*—Khanh Dang
*Attorney, Agent, or Firm*—Alix, Yale & Ristas, LLP

[57] ABSTRACT

A combined device is provided for positioning between the outlet of a gas turbine and a steam generator. The combined device acts as a sound-absorber and as a diffusor and is designated a gas turbine muffler. The gas turbine muffler has an inner zone which widens out in the flow direction S at a relatively large angle. Deflector elements arranged in this inner zone delineate diffusor channels, that are located between adjacent deflector elements. The diffusor channels widen out in each case at a significantly smaller acute angle of less than 7°. In addition to decelerating the stream of gas and hence, in addition, increasing the pressure, the narrow diffusor channels also bring about sound-absorption by reducing the regions of turbulence, making the stream more uniform, and aligning the stream. As a result of the additional function of the gas turbine muffler as a diffusor, the separate diffusors, which were required previously and which claimed a large amount of construction space, can be dispensed with.

19 Claims, 2 Drawing Sheets

GAS TURBINE MUFFLER WITH DIFFUSOR

BACKGROUND OF THE INVENTION

This invention relates generally to sound-absorbers, or mufflers, for gas turbine units. More particularly, the present invention relates to mufflers for stationary gas turbine units.

Modern power stations utilize gas turbine units at least in part for the production of steam, whereby these units release not only mechanical energy, which is directly usable by electrical generators, but also a stream of hot gas, which is usable for the production of energy via steam generators. The gas turbine units replace conventional combustion units either completely or partly in this regard.

Gas turbines exhibit relatively high gas velocities at their outlet (exhaust). In addition, the flow is highly turbulent, at least in part, and the gas turbine emits a high level of sound at its outlet. The high flow velocity at the outlet of the gas turbine leads, as a consequence, to a very low static pressure. As a rule, it is necessary to decelerate the gas flow significantly in favor of the static pressure. A diffusor serves for this purpose and is usually formed by a long channel which gradually widens out. In order to achieve the desired diffusor action, the opening angle of this channel, which widens out, is not permitted to be too large. This leads to construction lengths of significantly more than 10 m, for example 13 m, in the required cross-sectional enlargements of the flow channel with conventional diffusor entrance cross sections.

If, however, the static pressure of the gas stream has been increased by controlled deceleration in the diffusor, then a considerable level of sound is still present which needs to be reduced. Thus mufflers are usually provided in the case of conventional gas turbine units and these mufflers are connected to the diffusor in question. Thus, in total, a relatively voluminous plant arises, which is connected to the gas turbine, whereby the plant comprises the diffusor and a serially connected muffler. This plant not only occupies valuable construction space but it generally exhibits an undesirably high back-wash or pressure loss. This reduces the output of mechanical energy by the gas turbine.

SUMMARY OF THE INVENTION

Briefly stated, the invention in a preferred form is a gas turbine muffler which utilizes a diffusor as the sound-absorber. This is achieved by way of the feature that the inner zone of the muffler is subdivided into diffusor channels, which are preferably arranged next to one another, by means of deflector elements. These each open in the flow direction, whereby—even in the case of small opening angles of the flow cross section—the percentage flow cross sectional area increases relatively markedly in each diffusor channel. The increase is distinctly greater than in the case of a single diffusor channel with the same opening angle and a correspondingly larger entrance cross sectional area.

A two-fold gain in space is achieved in this way. A larger gain in space arises by combining the diffusor and the sound-absorber with one another during construction. An additional significant shortening of the construction length is achieved via the subdivision of the flow channel into many parallel diffusor channels, i.e. diffusor channels that are connected to one another at the inlet end and at the outlet end. Whereas a total construction length of between 10 and 15 m was required for conventional gas turbine sound-absorbers and diffusor units, the gas turbine muffler in accordance with the invention, which simultaneously takes on the function of a diffusor, suffices with a construction length of 4 to 5 m. Understandably, larger or smaller dimensions can arise in accordance with the desired output, whereby the ratio of the dimensions of known plants remains similar relative to the gas turbine muffler in accordance with the invention. The reduced overall dimensions facilitate thermal insulation and already reduce heat loss as a result of the reduced surface area of the plant.

The transfer location between the sound-absorber and the diffusor which is required in conventional systems is eliminated as a result of constructionally and functionally combining the sound-absorber and the diffusor. Because of the flow resistance, which is undergoing change here, such transfer locations can produce a loss in pressure which has to be overcome by the turbine and this therefore reduces its performance level. This is avoided in the case of the gas turbine muffler in accordance with the invention. Relative to conventional plants, a gain in pressure of 2 to 3 mbars can be produced.

The inner zone of the housing of the gas turbine muffler is subdivided into diffusor channels by individual deflector elements. The deflector elements produce alignment of the stream by prescribing its flow path. In order to withstand the thermal stress which arises, the deflector elements can be constructed in the form of e.g. a steel framework which is provided with ceramic fibers. An additional sound-absorbing effect is produced as a result of the structure of the ceramic fabric. In addition, the housing can, for example, be clad with a ceramic fabric at least partially on the inside, whereby this is in order to muffle the transfer of sound to the outside.

Irrespective of the material that is used, the deflector elements are preferably constructed in the form of flow elements which oppose the gas flow by a resistance, which is as low as possible, and which produce as little additional turbulence as possible. In this regard, the deflector elements can be constructed in the form of plates, for example, whose thickness increases from the upstream end toward the downstream end and which have been rounded off both at their upstream end and at their downstream end. Despite the increase in thickness of the flow elements in the flow direction, intermediate zones (diffusor channels) remain behind between the deflector elements, whereby the flow cross sectional area of the intermediate zones increases in the flow direction. The diffusor channels are, for example, constructed in slot-like manner, i.e. the flow cross section is formed by a narrow rectangle whose short edge increases in the downstream direction whereas the longer edge remains unchanged. In this way, a relatively high percentage increase in cross sectional area is possible with small opening angles which permit good diffusor action. Depending on the requirements, the deflector elements can also have a constant thickness or a thickness which changes in some other way in the flow direction, e.g. a decreasing thickness.

Alternatively, the deflector elements can be constructed, for example, in a ring-shaped manner in the form of round or rectangular elements. Here, also, it is possible to construct the diffusor channels in the form of a relatively narrow gap, whose thickness, or width, increases in the flow direction. Thus good diffusor action is possible with a short construction length.

In an advantageous form of embodiment, the sum of the flow cross sectional areas of the diffusor channels at the inlet end essentially corresponds to the flow cross sectional area of the inlet of the gas turbine muffler or is appropriately optimized with respect to this. This avoids pressure losses independently of whether the inlet has a rectangular or a round cross section. If the cross section is round, then it can be advantageous if the resulting flow cross sectional area, which arises from the sum of the cross sectional areas of the diffusor channels at the inlet end, is somewhat greater than the cross sectional area of the inlet.

The deflector elements are preferably rectangular plates when seen in a lateral view, whereby these are arranged essentially vertically in the horizontal flow-through direction in the gas turbine muffler. In this regard, the deflector elements are preferably fastened at their underside. They are merely fixed laterally at their upper end, so that they are capable of moving up and down. This avoids stresses during rapid heating up and cooling down. A very rapid heating up process is found especially when starting gas turbines. Temperature induced stresses are minimized as a result of the unilateral fastening of the deflector elements.

An adaptation zone, i.e. an entrance zone and an exit zone, is arranged, in each case, preferably both in front of the deflector elements and thereafter in order to adapt the flow cross sections in the diffusor region at the inlet and outlet. A grid is preferably arranged in the entrance zone which subdivides the stream that is delivered by the gas turbine at 80 to 150 m/s. In this connection, a grid bar with, for example, a round cross section is preferably allocated to each deflector element. The grid bar is arranged at a distance of several centimeters from the front edge of each deflector element. The bar which serves as a flow divider or turbulence breaker produces a wind shadow to a certain extent in which a deflector element is then arranged in each case. The flow resistance which arises is less than in the case of arrangements without flow-dividers.

The deflector elements are preferably arranged not only obliquely to one another (angle $\alpha$) but they are also wedge-shaped and therefore become thicker from the inlet to the outlet. This results in good superimposition of the sound-absorbing action with the diffusor action and, at the same time, advantageously slow flow conditions at the outlet.

It is an object of the invention to provide a new and improved muffler for a stationary gas turbine unit.

It is also an object of the invention to provide a new and improved muffler for a gas turbine unit which requires as little construction space as possible.

It is further an object of the invention to provide a new and improved muffler for a gas turbine unit which impairs the mechanical efficiency of the gas turbine unit as little as possible.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
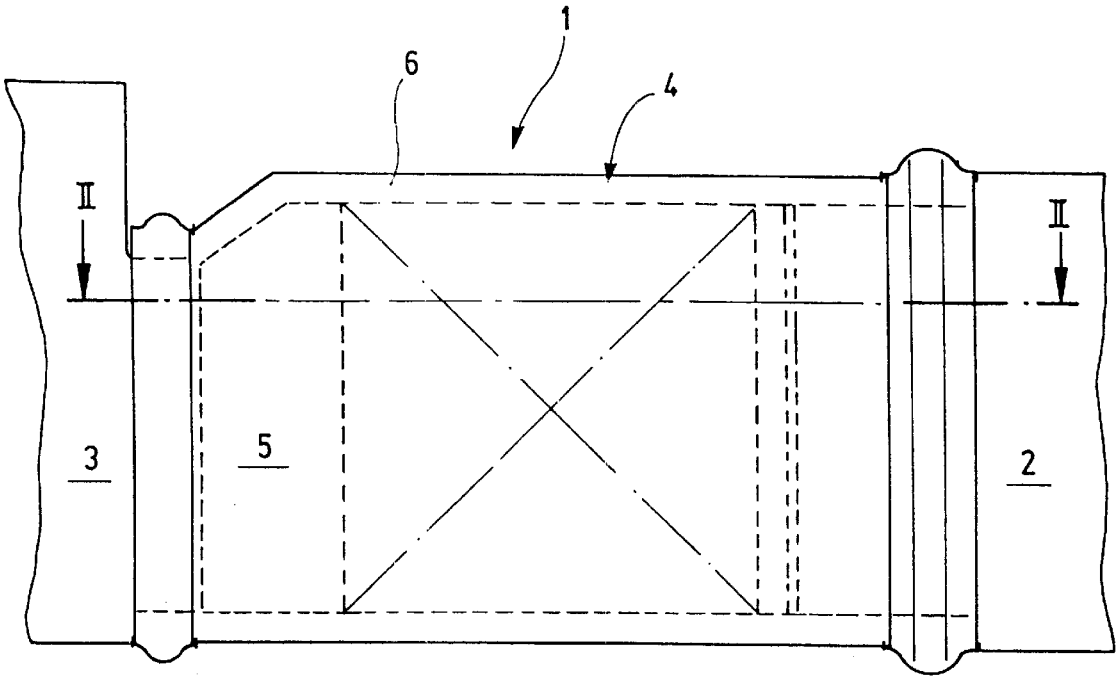
FIG. 1, is a schematic lateral view, partly in phantom, of a gas turbine muffler in accordance with the invention positioned intermediate a gas turbine and a steam generator.

With reference to the drawings wherein like numerals represent like parts throughout the several figures, a gas turbine muffler in accordance with the present invention is generally designated by the numeral 1. The gas turbine muffler 1 is connected to the outlet of a gas turbine 2 of a stationary energy production plant and leads to a steam generator 3. The gas turbine muffler 1 serves the purpose of settling down and decelerating the exhaust gases, which typically leaves the gas turbine 2 at a velocity of more than 100 m/s, in order to release them to the steam generator 3 at a velocity of less than 30 meters per second. For this purpose, the gas turbine muffler 1 has a housing 4 which encloses an inner zone 5. In order to avoid undesired cooling down of the exhaust gases of the gas turbine 2, whereby these gases flow through the gas turbine muffler 1, the housing 4 is provided with an insulating layer 6 for thermal insulation purposes.

The housing 4 has a virtually constant height. However, the width of the housing 4 increases from the gas turbine 2 toward the steam generator 3. The housing 4 is provided with an inlet 7 at the gas turbine end, whereby the cross section of the inlet is rectangular. A compensator 8 is arranged at the inlet 7 and equalizes thermal expansions in a springy flexible manner. The compensator connects the outlet of the gas turbine 2 to the inlet 7 of the housing 4 in a fluid-tight manner. In addition, the housing 4 is provided with an outlet 9 for the purposes of connection to the steam generator 3, whereby the outlet is formed via an opening which is also rectangular. A compensator 11 is arranged at the outlet 9, whereby the compensator equalizes the thermally induced displacements between the steam generator 3 and the housing 4.

Figure 2:
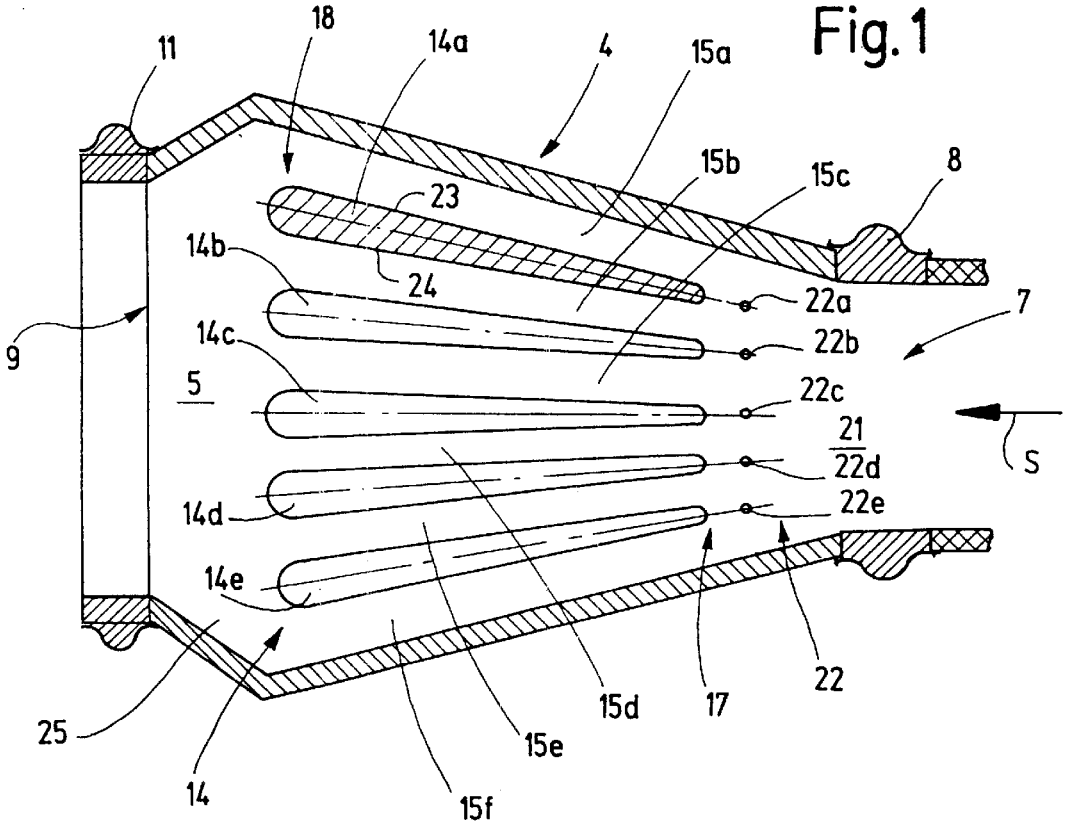
FIG. 2, is a cross-sectional view taken along line II—II of FIG. 1.

Several deflector elements 14 (14*a* through 14*e*) are arranged in the inner zone 5 of the housing 4 which widens out at an opening angle of approximately 30° in the flow direction S (see arrow in FIG. 2). In the present case, a total of five deflector elements are provided, whereby the number can vary from case to case. The deflector elements 14 are, in essence, mutually identically constructed elements, e.g. plate-shaped elements, which consist of a steel framework with a ceramic fiber overlay. The deflector elements 14 are arranged in an upright manner in the inner zone 5 and subdivide the inner zone 5, which forms the flow channel and which extends from the inlet 7 to the outlet 9, into the individual diffusor channels 15 (15*a* to 15*f*).

Figure 3:
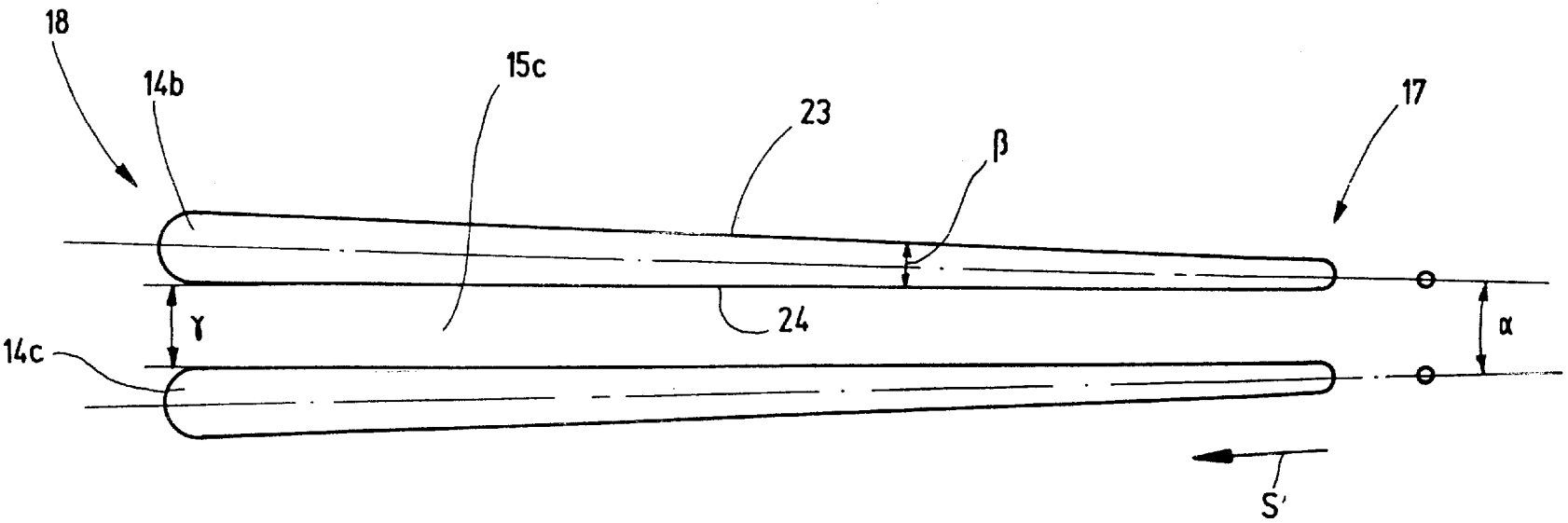
FIG. 3, is an enlarged cross-sectional view of two of the deflector elements of FIG. 2.

The diffusor channels 15 are relatively narrow. Whereas they can have a height of 4000 millimeters at their entrance, for example, they are only approximately 200 millimeters wide. They are therefore gap-like or slot-shaped. As FIG. 3 shows, the individual diffusor elements become thicker in the flow direction, i.e. from their upstream end 17 toward their downstream end 18 in each case. Diffusor elements 14, which are adjacent to one another, are arranged in each case in such a way that they enclose an acute angle a relative to one another which is preferably smaller than 7°. The diffusor channel 15 widens out correspondingly less as a result of the increase in the thickness of the diffusor elements 14 in the flow direction. Nevertheless, one achieves a large percentage increase in the flow cross sectional area and thus good deceleration and an increase in pressure of the gas stream which is flowing through. Without deflector elements 14, the widening-out inner zone 5 of the muffler would no longer act as a diffusor because of the angle of divergence, of approximately 30°, between the two lateral walls of the housing 4.

The deflector elements 14 therefore take on a double function. On the one hand, they define the diffusor channels 15, which are located between one another, and, on the other hand, they align the turbulent stream, which is arriving from the gas turbine 2, and make this more uniform.

The diffusor element 14 has essentially planar lateral surfaces 23, 24 (FIG. 3) which mutually enclose an acute angle β. This amounts to only a few degrees (for example 3 to 5°). At its front or upstream end, the deflector element 14 is rounded off using a certain radius. Likewise, the deflector element 14 is rounded off at its downstream or rear end 18 using a certain radius. As a result of the approximately wedge-shaped formation of the diffusor elements using the angle β, a channel, which is wedge-shaped in the plan view, is formed from two mutually adjacently arranged diffusor elements 14 with an angle of opening y. The following relationship applies: $y=\alpha-\beta$.

An entrance zone 21 is constructed in the inner zone 5 in front of the upstream ends 17 of the deflector elements 14, whereby the flow cross sectional area in the entrance zone increases—starting out from the inlet 7—by approximately the dimension of the front surfaces of the deflector elements 14. Grid bars 22 (22*a* through 22*e*) are arranged in this entrance zone 21. Each grid bar 22 is thereby allocated to a deflector element 14 and is arranged at a predetermined distance in front of it. This distance corresponds approximately to the thickness of the deflector element in question, as measured in the middle between its upstream end 17 and its downstream end 18. The grid bars have a round cross section and are aligned parallel to the deflector elements, i.e. they are arranged in, or parallel to, imaginary planes which are defined by the lateral surfaces 23, 24 of each deflector element 14.

An empty space, which serves as the exit zone 25, remains over between the downstream ends of the deflector elements 14 and the outlet 9. Whereas the entrance zone 25 forms a region of divergence, at which the diffusor channels 15 are connected to one another at the inlet end, the exit zone forms a region of convergence, or a collection zone, for the gases which emerge from the diffusor channels 15.

In operation, a gas stream at a high velocity of, for example, 100 to 120 m/s arrives from the gas turbine 2 in the flow direction S. The gas stream enters the entrance zone 21 and impinges first of all on the grid bars 22. The stream is divided here and is subdivided into the diffusor channels which are defined between the deflector elements 14. Because of the small distances of the deflector elements from one another, the stream is forced into an essentially linear path in this manner and it therefore becomes more uniform. While flowing through the diffusor channels 15, the gas stream decelerates to a value between 23 and 27 m/s as a result of the markedly increasing flow cross sectional area and the pressure (static pressure) increases correspondingly.

The partial gas streams from the diffusor channels 15*a* through 15*f* combine in the exit zone 25 to give one total stream of gas which emerges at the outlet 9. This corresponds essentially to the sum of the individual cross sectional areas of the diffusor channels 15 at the outlet end.

A combined device 1 is provided in order to carry out the intermediate positioning of the sound-absorbing components between the outlet of a gas turbine 2 and a steam generator 3, whereby this combined device acts both as a sound-absorber and as a diffusor and is designated a gas turbine muffler. The gas turbine muffler 1 has an inner zone 5 which widens out in the flow direction S at a relatively large angle. Deflector elements 14 are arranged in this and delineate the diffusor channels 15, which are arranged between one another, whereby the diffusor channels open out in each case at a significantly smaller acute angle of less than 7°. In addition to bringing about deceleration of the stream of gas and hence, additionally, increasing the pressure, the narrow, gap-like diffusor channels 15 also bring about sound absorption as a result of reducing the regions of turbulence and making the stream more uniform and aligning the stream. As a result of the additional function of the gas turbine muffler 1 as a diffusor, the separate diffusers, which were required previously and which claimed a large amount of construction space, can be dispensed with.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Gas turbine sound-absorber for a power plant having a gas turbine unit and a steam generator, the gas turbine unit having a gas exit zone emitting a flow of gas, the steam generator having a gas entrance zone, the sound-absorber comprising:

a housing having an inlet, an outlet, and an inner zone forming a gas flow channel having a flow direction from the inlet to the outlet, the inlet being connectable to the gas exit zone of the gas turbine and the outlet being connectable to the gas entrance zone of the stream generator; and a plurality of deflector elements arranged in the inner zone, the deflector elements having inlet and outlet ends and subdividing the flow channel into a plurality of diffusor channels which are connected to one another at the inlet and outlet ends of the deflector elements, each of the diffusor channels having a flow cross sectional area which increases in the flow direction substantially from the inlet end to the outlet end of the deflector elements;

wherein the sound-absorber diffuses the flow of gas and absorbs sound from the flow of gas within the inner zone.

2. Gas turbine muffler in accordance with claim 1 wherein each of the deflector elements has a thickness which increases from the inlet end to the outlet end.

3. Gas turbine muffler in accordance with claim 1 wherein the inlet of the housing has a cross sectional area and an inner zone inlet flow cross sectional area is defined by the sum of the flow cross sectional areas of the diffusor channels at the inlet end of the deflector elements, the inner zone inlet flow cross sectional area being substantially equal to the cross sectional area of the inlet of the housing.

4. Gas turbine muffler in accordance with claim 3 wherein the inlet has a rectangular cross section.

5. Gas turbine muffler in accordance with claim 1 wherein the inner zone of the housing has a rectangular or square cross section.

6. Gas turbine muffler in accordance with claim 1 wherein the outlet has a rectangular cross section.

7. Gas turbine muffler in accordance with claim 1 wherein each of the deflector elements has two flat lateral surfaces which, together, enclose an acute angle relative to one another.

8. Gas turbine muffler in accordance with claim 1 wherein each of the deflector elements has front and rear ends which are rounded.

9. Gas turbine muffler in accordance with claim 1 wherein each of the deflector elements is constructed in a rectangular manner when viewed laterally.

10. Gas turbine muffler in accordance with claim 1 wherein the deflector elements are arranged in pairs and the deflector elements of each pair enclose an acute angle relative to one another.

11. Gas turbine muffler in accordance with claim 1 wherein each of the deflector elements has an underside which is mounted to the housing and an upperside which is restrained from lateral movement.

12. Gas turbine muffler in accordance with claim 1 wherein the inner zone of the housing has an entrance zone disposed intermediate the inlet and the deflector elements, the inlet has a cross sectional area, and an inner zone inlet flow cross sectional area is defined by the sum of the flow cross sectional areas of the diffusor channels at the inlet end of the deflector elements, the entrance zone providing a transition from the inner zone inlet flow cross sectional area to the inner zone inlet flow cross sectional area.

13. Gas turbine muffler in accordance with claim 12 further comprising a grid disposed in the entrance zone.

14. Gas turbine muffler in accordance with claim 13 wherein the grid comprises a plurality of grid bars, one of the grid bars being disposed upstream of each deflector element.

15. Gas turbine muffler in accordance with claim 14 wherein each grid bar is arranged parallel to a plane which is defined by a flat side of a deflector element.

16. Gas turbine muffler in accordance with claim 1 wherein the inner zone of the housing has an exit zone disposed intermediate the outlet and the deflector elements, the outlet has a cross sectional area, and an inner zone outlet flow cross sectional area is defined by the sum of the flow cross sectional areas of the diffusor channels at the outlet end of the deflector elements, the exit zone providing a transition from the inner zone outlet flow cross sectional area to the outlet cross sectional area.

17. Gas turbine muffler in accordance with claim 1 wherein at least the deflector elements are provided with a sound-absorbing material.

18. Gas turbine muffler in accordance with claim 1 wherein each of the deflector elements has opposed sides defining a thickness which increases from the inlet end to the outlet end at a wedge angle $\beta$, the sides of adjacent deflector elements define an oblique angle $\alpha$, and that an increase in the flow cross sectional area of the diffuser channel formed between the adjacent deflector elements is reduced by the wedge angle $\beta$ relative to the oblique angle $\alpha$.

19. Gas turbine muffler in accordance with claim 1 wherein each of the deflector elements has two flat lateral surfaces which are arranged parallel to one another.

* * * * *